US005557289A

United States Patent [19]

Ohara

[11] Patent Number: 5,557,289

[45] Date of Patent: Sep. 17, 1996

[54] WINDOW GLASS ANTENNA DEVICE FOR AUTOMOBILES

[75] Inventor: Shohei Ohara, Ibaraki, Japan

[73] Assignee: Nippon Sheet Glass Co., Ltd., Japan

[21] Appl. No.: 544,147

[22] Filed: Oct. 17, 1995

Related U.S. Application Data

[63] Continuation of Ser. No. 160,036, Nov. 30, 1993, abandoned.

[30] Foreign Application Priority Data

Nov. 30, 1992 [JP] Japan ..... 4-343263

[51] Int. Cl.[6] ..... H01Q 1/32

[52] U.S. Cl. ..... 343/713; 343/704

[58] Field of Search ..... 343/713, 704; H01Q 1/32

[56] References Cited

U.S. PATENT DOCUMENTS

| | | | |
|---|---|---|---|
| 4,331,961 | 5/1982 | Davis | 343/713 |
| 4,727,377 | 2/1988 | Yotsuya et al. | 343/713 |
| 5,079,560 | 1/1992 | Sakurai et al. | 343/713 |
| 5,083,133 | 1/1992 | Takayama | 343/713 |

FOREIGN PATENT DOCUMENTS

| | | |
|---|---|---|
| 0559196 | 8/1993 | European Pat. Off. . |
| 63-147345 | 9/1988 | Japan . |

*Primary Examiner*—Michael C. Wimer

*Attorney, Agent, or Firm*—Merchant, Gould, Smith, Edell, Welter & Schmidt

[57] ABSTRACT

A window glass antenna device on an automobile window glass panel of an automobile includes a defrosting heater disposed on the automobile window glass panel, and a radio signal receiving antenna disposed on the automobile window glass panel. A loop-shaped remote control signal receiving antenna is disposed on the automobile window glass panel and extends from a feeder terminal on the window glass panel along outer peripheral edges of the automobile window glass panel around the defrosting heater and the radio signal receiving antenna. Alternatively, a first remote control signal receiving antenna is disposed on the automobile window glass panel and extends clockwise from a feeder terminal on the automobile window glass panel along an outer peripheral edge thereof, and a second remote control signal receiving antenna is disposed on the automobile window glass panel and extends counterclockwise from the feeder terminal along another outer peripheral edge thereof.

8 Claims, 4 Drawing Sheets

WINDOW GLASS ANTENNA DEVICE FOR AUTOMOBILES

This is a continuation of application Ser. No. 08/160,036, filed Nov. 30, 1993 now abandoned.

BACKGROUND OF THE INVENTION

1. Field of the Invention

The present invention relates to a window glass antenna device having a defrosting heater and a radio signal receiving antenna which are composed of thin wires or line patterns on a window glass panel of an automobile, and more particularly to a window glass antenna device including an antenna dedicated to an electronic key system on an automobile.

2. Description of the Prior Art

Conventional electronic key systems for use on automobiles allow doors, glove boxes, and trunk lids to be opened and closed under remote control using a transmitter unit carried by the user. Specifically, when operated by the user, the transmitter unit transmits a radio control signal, which is received by an antenna on the automobile body to cause the electronic key system to open or close the doors, the glove box, or the trunk lid.

There has been known a window glass antenna device having a defrosting heater and a radio signal receiving antenna which are composed of thin wires or line patterns on a window glass panel of an automobile, the defrosting heater or the radio signal receiving antenna being shared by an electronic key system.

FIG. 5A of the accompanying drawings shows a conventional window glass antenna device including a radio signal receiving antenna that is shared by an electronic key system, and FIG. 5B of the accompanying drawings shown another conventional window glass antenna device including a defrosting heater that is shared by an electronic key system.

In FIG. 5A, a window glass antenna device 21 comprises a window glass panel 22, a defrosting heater 23, and a radio signal receiving antenna 24, which is shared as an electronic key system antenna 25 by an electronic key system. The defrosting heater 23 and the radio signal receiving antenna 24 are disposed on the window glass panel 22. An amplifier 26 is connected to the window glass antenna device 21 for amplifying AM and FM radio waves received by the radio signal receiving antenna 24 and also amplifying a electronic key system control radio wave received by the electronic key system antenna 25. A power supply 27 such as a battery is also connected to the window glass antenna device 21 for supplying electric energy to the defrosting heater 23.

The defrosting heater 23 comprises a plurality of heater wires in the form of thin Nichrome (trade name) wires or a line pattern of printed and baked silver paste. The heater wires are connected at opposite ends to bus bars 23*a*, 23*b* which are connected through feeder terminals 23*c*, 23*d*, respectively, to the power supply 27 through a capacitor 30.

The radio signal receiving antenna 24 comprises a plurality of thin conductive wires or a line pattern of printed and baked silver paste.

The amplifier 26 is connected to a feeder terminal 24*a* that is connected to the radio signal receiving antenna 24, i.e., the electronic key system antenna 25. AM or FM radio waves received by the radio signal receiving antenna 24 or a control radio wave received by the electronic key system antenna 25 is detected and amplified by the amplifier 26, which outputs an AM or FM radio signal 26*b* and a control signal 26*a*.

Since the radio signal receiving antenna 24 is shared by the electronic key system, the AM or FM radio waves and the control radio wave received thereby tend to interface with each other, resulting in a reduction in the antenna performance. In addition, a long period of time is needed or additional parts are required to tune the radio signal receiving antenna 24 to different frequencies used in different geographical regions where automobiles with the window glass antenna devices are sold.

In FIG. 5B, a window glass antenna device 31 is similar to the window glass antenna device 21 shown in FIG. 5A except that the feeder terminals 23*c*, 23*d* of the defrosting heater 23 are connected through a choke coil 29 to the power supply 27, and the feeder terminal 24*a* of the radio signal receiving antenna 24 is connected through a DC blocking capacitor 28 to the amplifier 26. The defrosting heater 23 is shared as an electronic key system antenna 25 by an electronic key system. The choke coil 29 provides a high impedance for enabling the electronic key system antenna 25 to efficiently receive a control radio wave, and a low resistance to allow electric energy to be supplied efficiently from the power supply 27 to the defrosting heater 23.

A control radio wave which is received by electronic key system antenna 25 is transmitted as a control signal to the radio receiving antenna 24, and then supplied from the feeder terminal 24*a* through the DC blocking capacitor 28 to the amplifier 26. The amplifier 26 detects and amplifies the control signal, and outputs a control signal 26*a*.

Since the defrosting heater 23 is shared by the electronic key system, a long period of time is needed to tune the electronic key system antenna 25 to different frequencies used in different geographical regions where automobiles with the window glass antenna devices are sold. Furthermore, the window glass antenna device shown in FIG. 5B requires the chock coil 29 and the DC block capacitor 28 as additional parts.

SUMMARY OF THE INVENTION

It is therefore an object of the present invention to provide a window glass antenna device including an antenna dedicated to an electronic key system, which antenna can easily be tuned to different frequencies and does not produce much signal interference with a radio signal receiving antenna, the window glass antenna device requiring a relatively small number of additional parts.

According to the present invention, there is provided a window glass antenna device on an automobile window glass panel of an automobile, comprising a defrosting heater disposed on the automobile window glass panel, a radio signal receiving antenna disposed on the automobile window glass panel, and a loop-shaped remote control signal receiving antenna disposed on the automobile window glass panel and extending from a feeder terminal on the window glass panel along outer peripheral edges of the automobile window glass panel around the defrosting heater and the radio signal receiving antenna. The remote control signal receiving antenna may comprise a single conductive antenna wire mounted on the automobile window glass panel. The remote control signal receiving antenna may comprise a single conductive antenna pattern printed on the automobile window glass panel. The remote control signal receiving antenna may comprise an electronic key system antenna.

According to the present invention, there is also provided a window glass antenna device on an automobile window glass panel of an automobile, comprising a defrosting heater disposed on the automobile window glass panel, a radio signal receiving antenna disposed on the automobile window glass panel, a first remote control signal receiving means disposed on the automobile window glass panel and extending clockwise from a feeder terminal on the automobile window glass panel along an outer peripheral edge thereof, and a second remote control signal receiving antenna disposed on the automobile window glass panel and extending counterclockwise from the feeder terminal along another outer peripheral edge thereof. Each of the first and second remote control signal receiving antennas comprises a single conductive antenna wire mounted on the automobile window glass panel. Each of the first and second remote control signal receiving antennas comprises a single conductive antenna pattern printed on the automobile window glass panel. Each of the first and second remote control signal receiving antennas may comprise an electronic key system antenna.

Since the remote control signal receiving antenna or antennas are independent of the radio signal receiving signal, the remote control signal receiving antenna or antennas are subject to less signal interference with the radio signal receiving antenna. The remote control signal receiving antenna or antennas which are single antenna elements can be placed in a relatively small space on the window glass panel. The remote control signal receiving antenna or antennas can easily be tuned to a desired frequency or frequencies simply by varying the length of the antenna element or elements.

The above and further objects, details and advantages of the present invention will become apparent from the following detailed description of preferred embodiments thereof, when read in conjunction with the accompanying drawings.

DETAILED DESCRIPTION OF THE PREFERRED EMBODIMENTS

Figure 1:
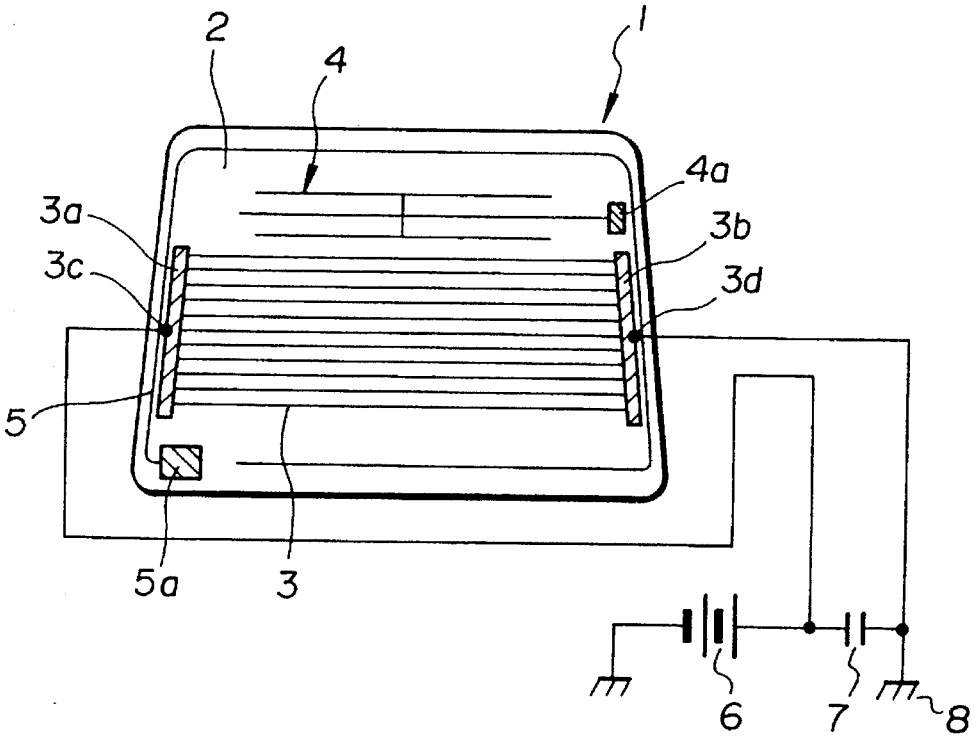
FIG. 1 is a schematic plan view of a window glass antenna device according to an embodiment of the present invention.

As shown in FIG. 1, a window glass antenna device 1 according to an embodiment of the present invention comprises a window glass panel 2 such as a rear window glass panel of an automobile, a defrosting heater 3, and an AM/FM radio signal receiving antenna 4, and an electronic key system antenna 5 of an electronic key system of the automobile. The defrosting heater 3, the radio signal receiving antenna 4, and the electronic key system antenna 5 are disposed on the window glass panel 2. The radio signal receiving antenna 4 is positioned upwardly of and spaced from the defrosting heater 3. The defrosting heater 3 comprises a plurality of heater wires in the form of thin Nichrome (trade name) wires or a line pattern of printed and baked silver paste. The heater wires are connected at opposite ends to bus bars 3*a*, 3*b* which are connected through feeder terminals 3*c*, 3*d*, respectively, to a power supply 6 through a capacitor 7 for absorbing power supply noise. One terminal of the capacitor 7 to which the feeder terminal 3*d* is connected is grounded at 8. The radio signal receiving antenna 4 comprises a plurality of thin conductive wires or a line pattern of printed and baked silver paste terminating at a feeder terminal 14*a*.

The electronic key system antenna 5 comprises a loop-shaped single antenna element extending around the defrosting heater 3 and the radio signal receiving antenna 4. The antenna element of the electronic key system antenna 5 may comprise a conductive antenna wire mounted on the window glass panel 2 or a conductive antenna pattern printed on the window glass panel 2. The frequency that can be received by the electronic key system antenna 5 can be adjusted by varying the length of the antenna element of the electronic key system antenna 5. The single antenna element of the electronic key system antenna 5 can be placed in a relatively small space on the window glass panel 2.

As shown in FIG. 1, the electronic key system antenna 5 includes a feeder terminal 5*a* connected to one end of the antenna element thereof, the feeder terminal 5*a* being positioned at a lower left-hand corner of the window glass panel 2. The antenna element extends upwardly from the feeder terminal 5*a* along a left-hand outer peripheral edge of the window glass panel 2 between the bus bar 3*a* and the left-hand outer peripheral edge of the window glass panel 2, and is bent at an upper left-hand corner of the window glass panel 2 and extends horizontally to the right along an upper outer peripheral edge of the window glass panel 2. The antenna element is then bent at an upper right-hand corner of the window glass panel 2 and extends downwardly along a right-hand outer peripheral edge of the window glass panel 2, and being at a lower right-hand corner of the window glass panel 2 and extends horizontally to the left along a lower outer peripheral edge of the window glass panel 2 to a position short of the feeder terminal 5*a*.

The electronic key system antenna 5 is located inwardly of a flange of the automobile body which extends along the outer peripheral edges of the window glass panel 2. The electronic key system antenna 5 may be formed on the window glass panel 2 if the distance between the bus bar 3*a* and the automobile body flange is about 10 mm.

Since the electronic key system antenna 5 is independent on the defrosting heater 3 and the radio signal receiving antenna 4, the electronic key system antenna 5 can be designed freely for reduced signal interference with the radio signal receiving antenna 4. The electronic key system antenna 5 can readily be tuned to the frequency that is used in a geographic region where the automobile is sent, simply by adjusting the length of the antenna element thereof, which may comprise a thin conductive wire or a line pattern.

Figure 2:
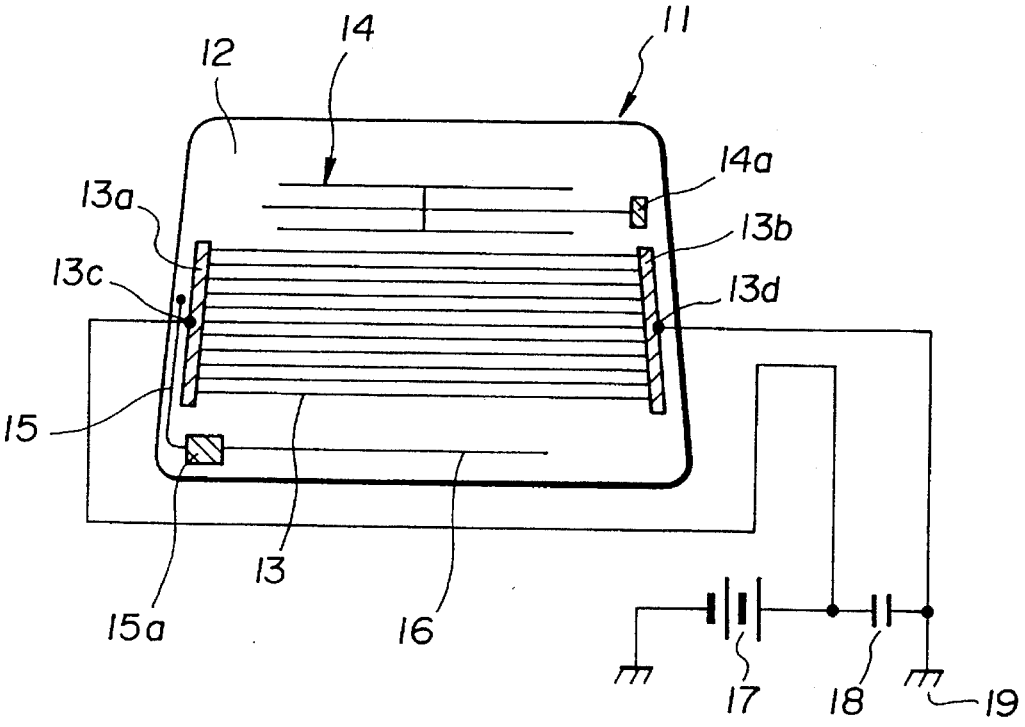
FIG. 2 is a schematic plan view of a window glass antenna device according to another embodiment of the present invention.

As shown in FIG. 2, a window glass antenna device 11 according to another embodiment of the present invention comprises a window glass panel 12 such as a rear window glass panel of an automobile, a defrosting heater 13, and an AM/FM radio signal receiving antenna 14, and first and second electronic key system antennas 15, 16 of an electronic key system of the automobile. The defrosting heater 13, the radio signal receiving antenna 14, and the electronic key signal antenna 15 are disposed on the window glass panel 12. The radio signal receiving antenna 14 is positioned upwardly of and spaced from the defrosting heater 13. The defrosting heater 13 comprises a plurality of heater wires in the form of thin Nichrome (trade name) wires or a line pattern of printed and baked silver paste. The heater wires are connected at opposite ends to bus bars 13*a*, 13*b* which are connected through feeder terminals 13*c*, 13*d*, respectively, to a power supply 17 through a capacitor 18 for absorbing power supply noise. One terminal of the capacitor 18 to which the feeder terminal 13*d* is connected is grounded at 19. The radio signal receiving antenna 14 comprises a plurality of thin conductive elements or a line pattern of printed and baked silver paste terminating at a feeder terminal 14*a*.

The first and second electronic key system antennas 15, 16 have ends connected to a feeder terminal 15*a* positioned at a lower left-hand corner of the window glass panel 12. The first electronic key system antenna 15 comprises an antenna element that extends from the feeder terminal 15*a* upwardly (clockwise) along a left-hand outer peripheral edge of the window glass panel 12 between the bus bar 13*a* and the left-hand outer peripheral edge of the window glass panel 12, and terminating short of the upper end of the bus bar 13*a*. The second electronic key system antenna 16 comprises an antenna element that extends from the feeder terminal 15*a* horizontally to the right (counterclockwise) along a lower outer peripheral edge of the window glass panel 12, and terminating at a position beyond the vertical central axis of the window glass panel 12. The antenna element of each of the first and second electronic key system antennas 15, 16 may comprise a conductive antenna wire mounted on the window glass panel 2 or a conductive antenna pattern printed on the window glass panel 2.

The frequencies that can be received by the electronic key system are determined by the lengths of the first and second electronic key system antennas 15, 16. The two electronic key system antennas 15, 16 can thus be tuned to different frequencies used in two different geographical regions where the automobile may be sent.

The lengths of the first and second electronic key system antennas 15, 16 may be switched around to change the frequencies which they receive. The number of electronic key system antennas may be increased to increase the number of frequencies that can be received.

Figure 3:
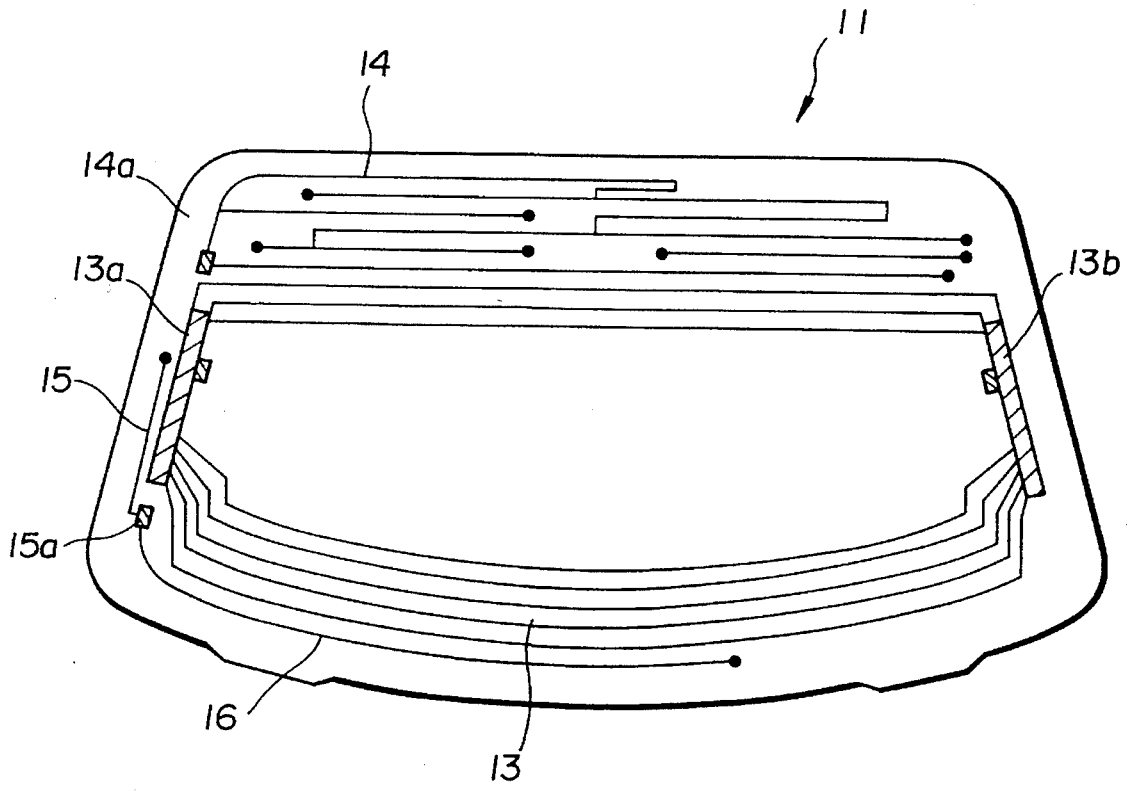
FIG. 3 is a plan view illustrating in detail the window glass antenna device shown in FIG. 2.

FIG. 3 shows in detail the window glass antenna device 11 shown in FIG. 2. In FIG. 2, the radio signal receiving antenna 14 comprises 15 antenna elements, and the defrosting heater 13 comprises 18 heater wires.

The first electronic key system antenna 15 which extends clockwise from the feeder terminal 15*a* has a length L2 of 220 mm which is selected to be tuned to a frequency of 315 MHz used in North America. The second electronic key system antenna 16 which extends counterclockwise from the feeder terminal 15*a* has a length L1 of 820 mm which is selected to be tuned to a frequency of 58.5 MHz used in Japan.

Figure 4A:
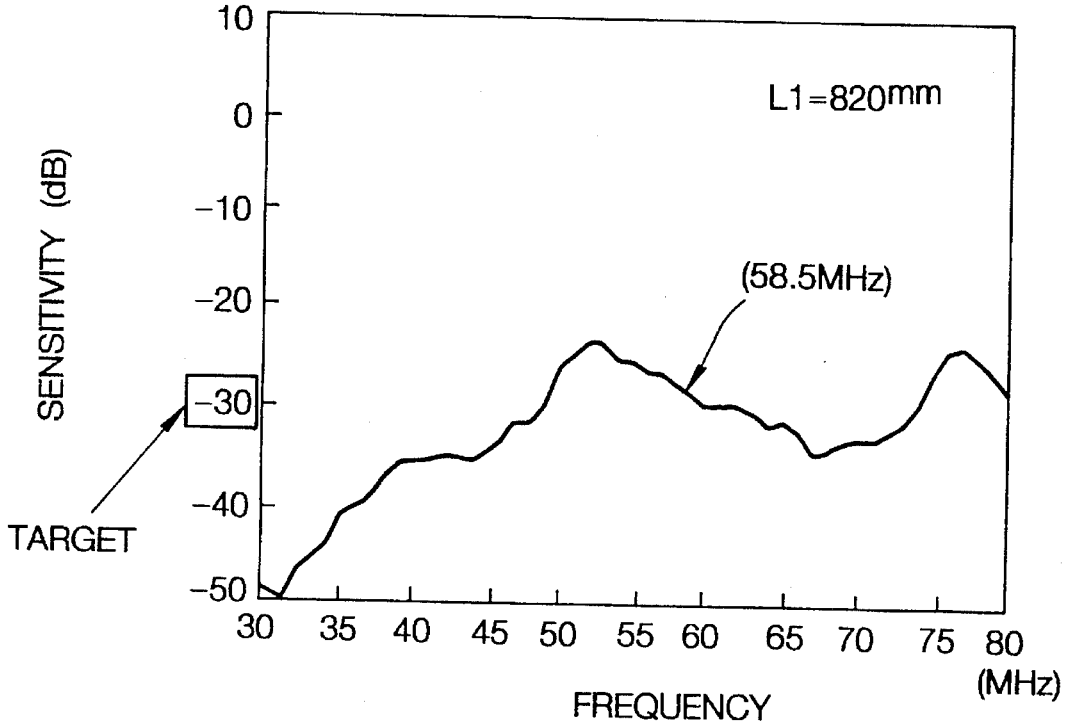
FIGS. 4A and 4B are diagrams of average sensitivity vs. frequency characteristics of the window glass antenna device shown in FIG. 3.

FIG. 4A is a graph showing average sensitivity vs. frequency characteristics of the second electronic key system antenna 16. It can be seen from FIG. 4A that the second electronic key system antenna 16 has a target sensitivity of −30 dB at the frequency of 58.5 MHz.

Figure 4B:
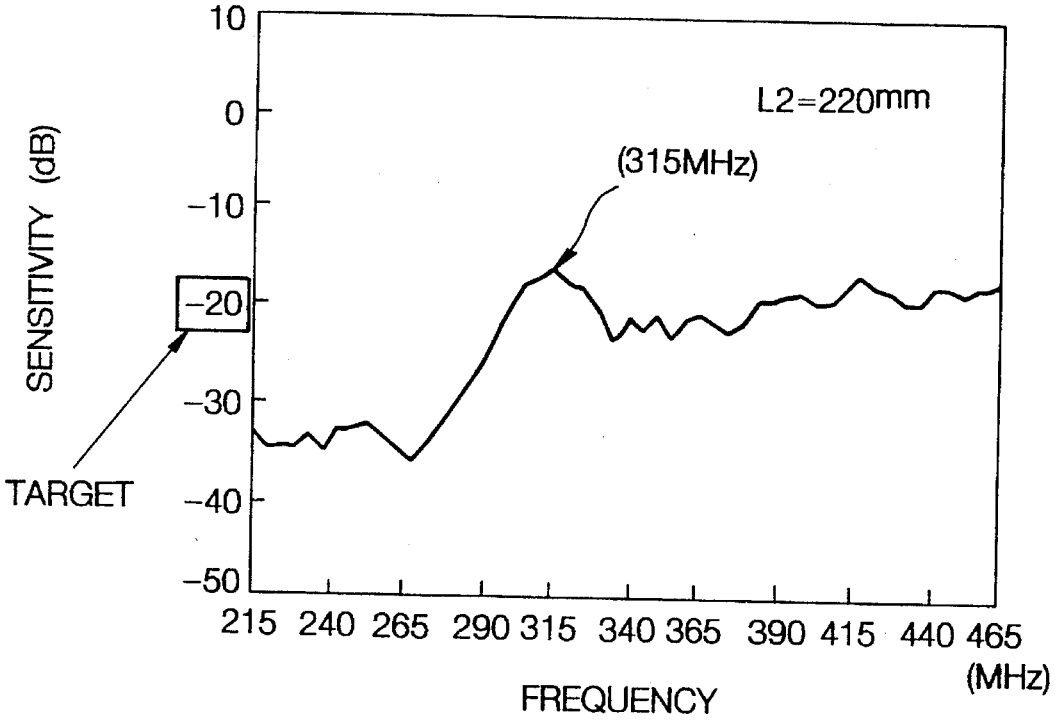
Figure 5A:
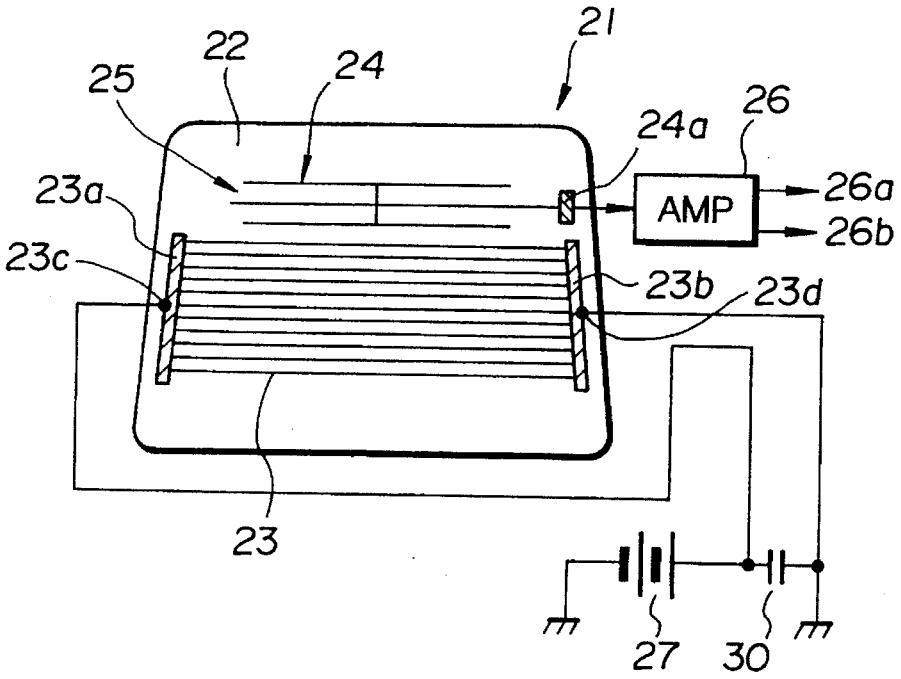
FIG. 5A PRIOR ART
FIGS. 5A and 5B are schematic plan views of conventional window glass antenna devices.
Figure 5B:
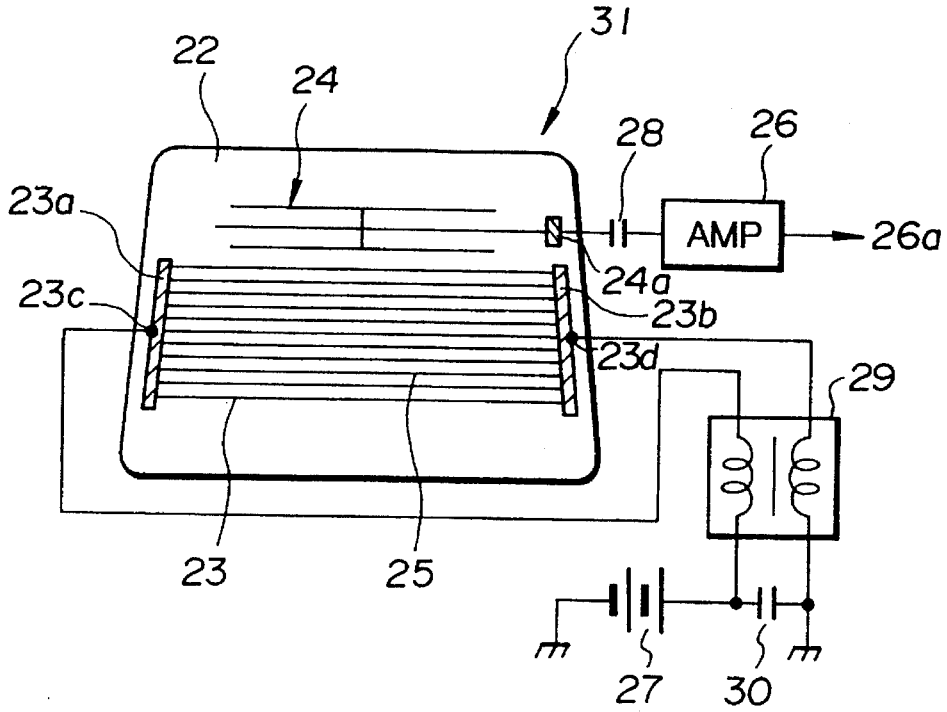
FIG. 5B PRIOR ART

FIG. 4B is a graph showing average sensitivity vs. frequency characteristics of the first electronic key system antenna 15. It can be seen from FIG. 4B that the first electronic key system antenna 15 has a target has a target sensitivity of −20 dB at the frequency of 315 MHz.

Although there have been described what are at present considered to be the preferred embodiments of the invention, it will be understood that the invention may be embodied in other specific forms without departing from the essential characteristics thereof. The present embodiments are therefore to be considered in all respects as illustrative, and not restrictive. The scope of the invention is indicated by the appended claims rather than by the foregoing description.

What is claimed is:

1. A window glass antenna device on an automobile window glass panel of an automobile, comprising:

a defrosting heater disposed on the automobile window glass panel;

a radio signal receiving antenna disposed on the automobile window glass panel; and a remote control signal receiving antenna disposed on the automobile window glass panel around said defrosting heater and said radio signal receiving antenna, said remote control signal receiving antenna extending from a feeder terminal on the window glass panel along a first outer peripheral edge of the window glass panel and bending to extend along a second outer peripheral edge of the window glass panel and bending to extend along a third outer peripheral edge of the window glass panel and bending to extend along a fourth outer peripheral edge of the window glass panel to a position short of the feeder terminal.

2. A window glass antenna device according to claim 1, wherein said remote control signal receiving antenna comprises a single conductive antenna wire mounted on the automobile window glass panel.

3. A window glass antenna device according to claim 1, wherein said remote control signal receiving antenna comprises a single conductive antenna pattern printed on the automobile window glass panel.

4. A window glass antenna device according to claim 1, wherein said remote control signal receiving antenna comprises an electronic key system antenna.

5. A window glass antenna device on an automobile window glass panel of an automobile, comprising:

a defrosting heater disposed on the automobile window glass panel with bus bars at opposite sides, said bus bars having upper and lower ends, said defrosting heater being on both sides of a vertical central axis of the window glass panel;

a radio signal receiving antenna disposed on the automobile window glass panel and spaced from said defrosting heater;

a remote control signal receiving antenna disposed on the automobile window glass panel and extending clockwise from a feeder terminal on the automobile window glass panel along an outer peripheral edge thereon between said defrosting heater and said outer peripheral edge and terminating short of the upper end of one of said bus bars; and a second remote control signal receiving antenna disposed on the automobile window glass panel and extending counterclockwise from the feeder terminal on one side of the vertical central axis along another outer peripheral edge thereof between said defrosting heater and said another outer peripheral edge and terminating at a position beyond the vertical central axis.

6. A window glass antenna device according to claim 5, wherein each of said first and second remote control signal receiving antennas comprises a single conductive antenna wire mounted on the automobile window glass panel.

7. A window glass antenna device according to claim 5, wherein each of said first and second remote control signal receiving antennas comprises a single conductive antenna pattern printed on the automobile window glass panel.

8. A window glass antenna device according to claim 5, wherein each of said first and second remote control signal receiving antennas comprises an electronic key system antenna.

* * * * *